US005501128A

United States Patent [19]

D'Amore

[11] Patent Number: 5,501,128

[45] Date of Patent: Mar. 26, 1996

[54] FLOATING DIE PAPER PUNCH

[75] Inventor: Michael D'Amore, Lake Villa, Ill.

[73] Assignee: ACCO USA, Inc., Wheeling, Ill.

[21] Appl. No.: 188,162

[22] Filed: Jan. 18, 1994

[51] Int. Cl.[6] ..... B26F 1/32

[52] U.S. Cl. ..... 83/599; 83/605; 83/687; 83/691; 83/699.61

[58] Field of Search ..... 83/599, 600, 561, 83/687, 658, 691, 686, 699.51, 699.61, 637, 829, 823, 827, 605, 635, 618, 623

[56] References Cited

U.S. PATENT DOCUMENTS

| | | | |
|---|---|---|---|
| 1,430,546 | 10/1922 | Hadaway | 83/623 |
| 3,172,325 | 3/1965 | Wernham et al. | 83/599 |
| 4,123,956 | 11/1978 | Harvey | 83/687 |
| 4,706,533 | 11/1987 | Giulie | 83/599 |
| 5,291,813 | 3/1994 | Blumenthal et al. | 83/599 |

*Primary Examiner*—Rinaldi I. Rada
*Attorney, Agent, or Firm*—Pennie & Edmonds

[57] ABSTRACT

A pin-type punch having an arm pivotal on a base in which the punch pins for punching sheets of paper are located on the arm or on the base and die holes on are located the opposite part. To create alignment of pin-to-hole, one or the other is mounted on or is in a floating unit. Each unit is caused to float by being positioned by engagement of punch alignment pieces just prior to the pins passing through the paper into the die holes.

10 Claims, 4 Drawing Sheets

FLOATING DIE PAPER PUNCH

BACKGROUND OF THE INVENTION

Paper punches made of molded plastic which punch holes in a limited number of sheets are old. Such prior punches have at times failed to align the top arm and base portion punching parts to accomplish adequate punching.

SUMMARY OF THE INVENTION

Broadly, the present invention comprises a punch having a base and an arm which includes punch pin elements and die holes the mating of which punches holes in sheets of paper. To create alignment of such pin element and the corresponding hole floating units are used which units carry either the pin element or its hole. As the arm and base are brought together, alignment projections cause the floating units to be properly positioned.

It is a feature that the punch may be molded of plastic material with tolerances to accomplish proper pin-hole alignment for punching.

DESCRIPTION OF THE PREFERRED EMBODIMENT

Figure 1:
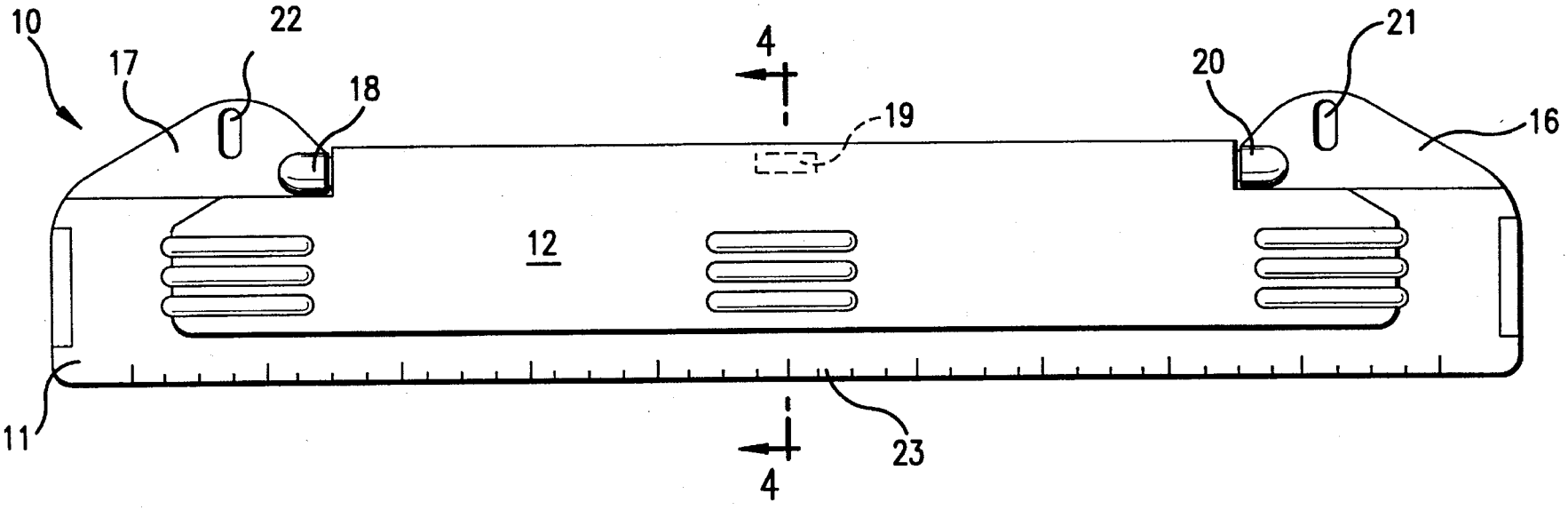
FIG. 1 is a plan view of the punch of the present invention with the top arm nearly closed.
Figure 2:
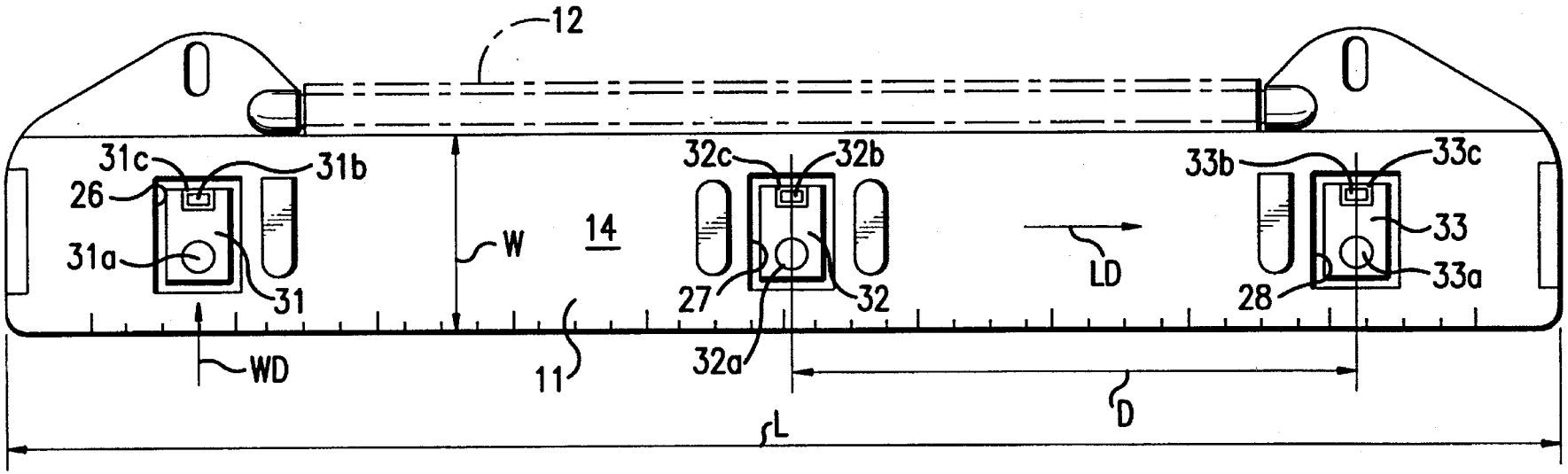
FIG. 2 is a plan view of the punch with the top arm removed revealing the floating die units.

In the Figures, punch 10 includes base 11 and pivotal top arm 12. Base 11 has body portion 14, ears 16, 17 with hinge mounts 18, 19, 20 and ring binder receiving holes 21, 22. Base 11 also includes measuring portion 23.

Body portion 14 having width (W) and length (L) includes three (3) recesses 26, 27 and 28 in which three (3) floating die units 31, 32 and 33 are positioned for small movement (about 0.015 inch) in recesses 26, 27, 28 in the longitudinal direction (LD) and in the transverse direction (WD). Each die unit 31, 32, 33 includes floating die holes 31*a*, 32*a*, 33*a* and guide opening 31*b*, 32*b*, 33*b*. The distances (D) between die holes 31*a* and 32*a* and between 32*a* and 33*a* are about 4.25 inches. Base 11 also includes base die holes 11*a*, which are aligned with and slightly larger than the floating die holes (see FIG. 3). Guide openings 31*b*, 32*b* and 33*b* also extend through die unit raised portions 31*c*, 32*c*, and 33*c*.

Figure 3:
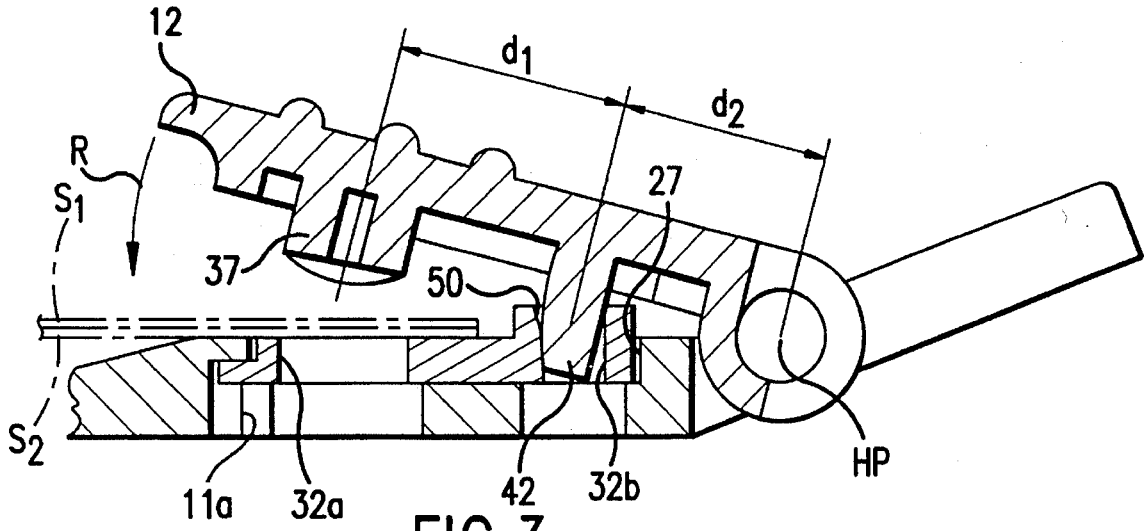
FIG. 3 is a sectional elevational view, similar to FIG. 4, showing the top arm in the open position.
Figure 4:
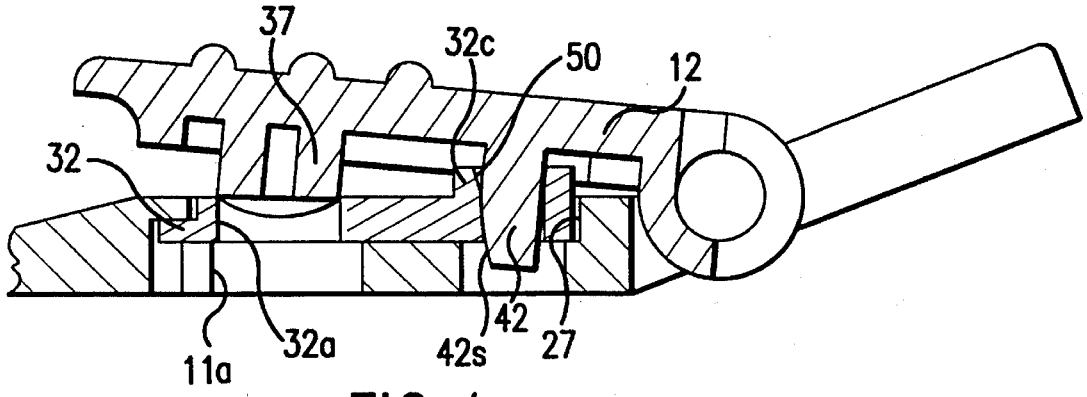
FIG. 4 is a sectional view taken along line 4—4 of FIG. 1.
Figure 5:
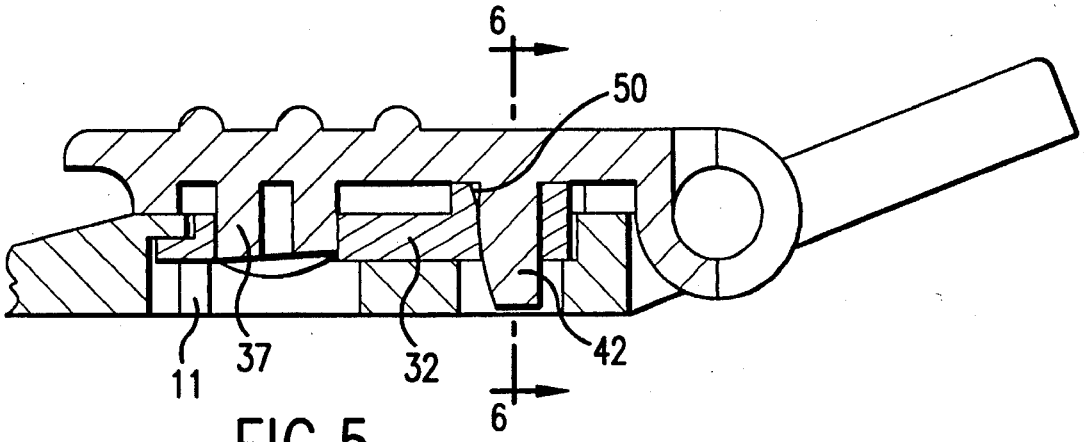
FIG. 5 is a sectional elevational view, similar to FIG. 4, showing the punch arm completely closed.

Turning to FIGS. 3–5, top arm 12, hinged about base hinge mounts 18, 19, 20, carries paper punch pins 37 and guide projections 42. Guide projections 42 enter floating unit guide openings 31, 32, 33 as top arm 12 is lowered through arc (R) (FIG. 3) about hinge pivot (HP) (FIG. 3). Projections 42 have curved front sides 42*s*. Openings 31*b*, 32*b* and 33*b* have partially flared front walls 50. The distances $d_1$ and $d_2$ between pivot HP and guide projection 42 is preferably less than one inch with distance $d_1$ being about 0.496 inch and $d_2$ about 0.379 inch. Projections 42 act to independently position their respective floating die units 31, 32, 33 in respective base recesses 26, 27, 28 (FIGS. 3 and 4) before punch pins 37 engage sheets $S_1$, $S_2$ (FIG. 3) and enter die holes 31*a*, 32*a*, 33*a* to punch sheets $S_1$ and $S_2$. Since distance $d_1$ is substantially less than distance D holding tolerances in plastic molding to improve pin-to-die alignment are greatly improved.

The floating die units 31, 32, and 33 are preferably rectangular but any shape may be used. Units 31, 32, 33 are smaller than recesses 26, 27 and 28 to permit units 31, 32, and 33 to move a short distance in any direction such as WD or LD to permit alignment of the punch pins 36, 37 and 38 with their die holes 31*a*, 32*a*, and 33 even though punch parts, as fabricated, assembled, and operated, might otherwise cause misalignment.

Figure 6:
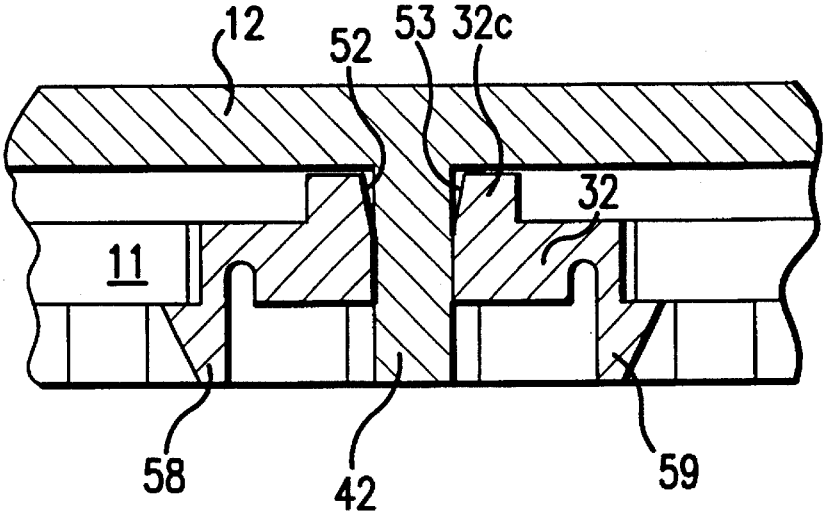
FIG. 6 is a sectional view through line 6—6 of FIG. 5.

In FIG. 6 it is seen that raised portion 32*c* has additional sloping sides 52, 53 for guiding projection 42 thereon. Floating unit 32 also includes lower wedge portions 58, 59 to retain unit 32 in base 11.

Figure 7:
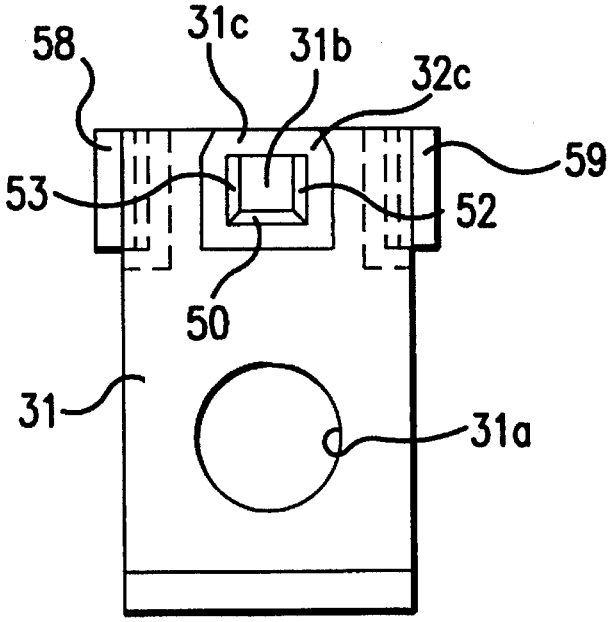
FIG. 7 is a plan view of a die unit.

Finally in FIG. 7, there is shown raised portion 32*c*, flared front walls 50, two flared side walls 52, 53, all such walls to guide projections 42. Also shown are guide opening 31*b* and die opening 31*a*.

I claim:

1. A punch for punching holes in a sheet comprising:

a) a base;

b) an arm pivotally movable with respect to the base;

c) pin punch elements mounted on the punch;

d) floating units including die holes mounted on the punch such holes for receiving the pin punch elements;

e) a first unit alignment guide element mounted on the arm and a second unit alignment guide element mounted on the unit, said guide elements engageable when the arm is pivoted, whereby the engagement of the first and second guide elements causes the unit to float and align the pin punch elements with the die hole in the unit.

2. The punch of claim 1 in which each floating unit has a die hole in it.

3. The punch of claim 1 in which each floating unit has a punch pin element mounted on it.

4. The punch of claim 1 in which the base, arm and floating units are molded of plastic.

5. The punch of claim 1 in which the punch has holes for positions on rings of a ring binder.

6. The punch of claim 1 in which the base includes a measuring portion.

7. The punch of claim 1 in which the floating units are mounted on the punch in recesses.

8. The punch of claim 7 in which the floating units move in said recesses in two directions which directions are perpendicular to one another.

9. The punch of claim 1 in which the first unit alignment guide element has a side which side is curved.

10. The punch of claim 1 in which the second unit alignment guide element includes sides which are sloping for guiding said first unit alignment guide element.

* * * * *